US008573434B2

(12) United States Patent
Bezek

(10) Patent No.: US 8,573,434 B2
(45) Date of Patent: Nov. 5, 2013

(54) IMPLOSION RESISTANT CONTAINER

(75) Inventor: Edward Anthony Bezek, Frisco, TX (US)

(73) Assignee: Frito-Lay North America, Inc., Plano, TX (US)

( * ) Notice: Subject to any disclaimer, the term of this patent is extended or adjusted under 35 U.S.C. 154(b) by 1946 days.

(21) Appl. No.: 11/608,170

(22) Filed: Dec. 7, 2006

(65) Prior Publication Data

US 2007/0090119 A1 Apr. 26, 2007

Related U.S. Application Data

(60) Division of application No. 10/614,323, filed on Jul. 7, 2003, now Pat. No. 7,163,123, which is a continuation-in-part of application No. 10/032,654, filed on Oct. 29, 2001, now abandoned.

(51) Int. Cl.
*B65D 1/48* (2006.01)

(52) U.S. Cl.
USPC ..... 220/675; 215/381

(58) Field of Classification Search
USPC ..... 220/675; 215/381
See application file for complete search history.

(56) References Cited

U.S. PATENT DOCUMENTS

| | | | | |
|---|---|---|---|---|
| 2,685,316 | A | 8/1954 | Krasno | |
| 2,894,844 | A | 7/1959 | Shakman | |
| 3,297,194 | A | 1/1967 | Schaper | |
| 3,325,031 | A | 6/1967 | Singier | |
| 3,680,763 | A * | 8/1972 | Ludder | 229/400 |
| 4,153,172 | A | 5/1979 | Bialobrzeski | |
| 4,155,474 | A * | 5/1979 | Bizzarri | 215/365 |
| 4,466,553 | A | 8/1984 | Zenger | |
| 4,609,113 | A | 9/1986 | Seki | |
| 4,615,928 | A | 10/1986 | Kawaguchi et al. | |
| 4,640,435 | A | 2/1987 | Dutt | |
| 4,912,048 | A | 3/1990 | Smith et al. | |

(Continued)

FOREIGN PATENT DOCUMENTS

WO 9708980 A1 3/1997

OTHER PUBLICATIONS

PCT/US02/34343, international filing date Oct. 25, 2005; See, PCT International Search Report mailed on Jun. 9, 2003 (from parent U.S. Appl. No. 10/032,654, filed Oct. 29, 2001).

*Primary Examiner* — Stephen Castellano
(74) *Attorney, Agent, or Firm* — Bobby W. Braxton; Colin P. Cahoon; Carstens & Cahoon, LLP

(57) ABSTRACT

The present invention overcomes many of the shortcomings inherent in previous containers for packaging potato chips and/or crisps, corn based chips and/or crisps, cookies and the like. The improved implosion-resistant container of the present invention utilizes flowing geometries mechanisms which allow a hermetically sealed container to smoothly change its geometric shape thereby adjusting its internal volume in response to changes in environmental conditions. These volumetric adjustments compensate for changes in environmental conditions thereby avoiding the random buckling and deformation inherent in current packaging techniques which detracts from the commercial presentation of the container. The improved container of the present invention may also include a variety of other stress dissipating mechanisms that counteract the forces causing thermo-plastic container deformation, implosion and loss of seal integrity. This collection of stress dissipating mechanisms, employed collectively or separately, allows a container for storing fragile food products to be fashioned as a relatively lightweight, thin-walled blow molded thermo-plastic container that is capable of adapting to changing environmental conditions while maintaining its visual aesthetic appearance.

5 Claims, 14 Drawing Sheets

(56) References Cited

U.S. PATENT DOCUMENTS

| | | | | | |
|---|---|---|---|---|---|
| 5,067,622 | A | * | 11/1991 | Garver et al. | 215/381 |
| 5,071,029 | A | | 12/1991 | Umiah et al. | |
| 5,125,512 | A | | 6/1992 | O'Leary | |
| 5,141,121 | A | | 8/1992 | Brown et al. | |
| 5,165,445 | A | | 11/1992 | Vertanen | |
| 5,167,344 | A | | 12/1992 | Van Schilt | |
| 5,273,086 | A | | 12/1993 | Estibal | |
| 5,584,413 | A | * | 12/1996 | Jung | 220/666 |
| 5,628,404 | A | | 5/1997 | Hendrix | |
| 5,692,626 | A | | 12/1997 | Wehrle et al. | |
| 5,704,503 | A | | 1/1998 | Krishnakumar et al. | |
| 5,850,908 | A | | 12/1998 | Jasek | |
| 5,911,338 | A | | 6/1999 | Miller | |
| 5,921,429 | A | | 7/1999 | Gruenbacher et al. | |
| 5,971,184 | A | | 10/1999 | Krishnakumar et al. | |
| 5,988,493 | A | | 11/1999 | Clougherty | |
| 6,006,945 | A | | 12/1999 | Kirkland | |
| 6,023,915 | A | | 2/2000 | Colombo | |
| 6,044,996 | A | * | 4/2000 | Carew et al. | 215/381 |
| 6,074,677 | A | | 6/2000 | Croft | |
| 6,149,955 | A | | 11/2000 | Wilson | |
| 6,223,920 | B1 | | 5/2001 | Lane et al. | |
| 6,257,438 | B1 | | 7/2001 | Von Holdt, Jr. | |
| 6,494,333 | B2 | | 12/2002 | Sasaki | |
| 7,163,123 | B2 | * | 1/2007 | Bezek | 220/675 |

* cited by examiner

IMPLOSION RESISTANT CONTAINER

CROSS-REFERENCE TO RELATED APPLICATIONS

This application is a divisional of U.S. application Ser. No. 10/614,323, filed Jul. 7, 2003, now U.S. Pat. No. 7,163,123, which is a continuation-in-part of U.S. patent application Ser. No. 10/032,654, filed on Oct. 29, 2001, now abandoned the technical disclosures of which are hereby incorporated herein by reference.

BACKGROUND OF THE INVENTION

1. Technical Field

The present invention generally relates to containers for storing fragile food products, and more particularly, to a blow molded container for storing potato chips and/or crisps, corn based chips and/or crisps, cookies and the like which is capable of adapting to changing environmental conditions while maintaining its visual aesthetic appearance.

2. Description of the Related Art

There are presently a great number of containers known for the storage of fragile food products (e.g., snack chips, crisps, cookies and the like). Inherent in every container's design is the requirement to compensate for or adapt to changing environmental conditions. Changes in environmental conditions (i.e., temperature, pressure and humidity) are a natural consequence of manufacturing processes. For example, dry food products are typically manufactured at elevated temperatures and thereafter hermetically sealed to protect the product from spoiling. Once sealed, a certain amount of gas is trapped within the container. As the contents of the hermetically sealed package cool to an ambient temperature, a partial vacuum is created which may cause the container to implode, distort or destroy the seal.

Changes in atmospheric pressure also affect the volume of gas trapped within a container. This is normally not a problem for dry food products because they are typically packaged in flexible packages (e.g., bags and flexible film overwraps) that can adjust their shape to changing environmental conditions. However, flexible packages offer little, if any, protection from outside physical forces to the contained fragile food products. Thus, increasingly, a need to use more rigid containers has arisen.

While rigid containers constructed of paper and foil are well known in the art, their utilization in packaging fragile food products presents many inherent drawbacks. The manufacturing costs of such rigid containers are relatively high. Moreover, in order to provide enough strength to resist forces induced by environmental change, the weight of such containers is relatively high. Additionally, changes in humidity can adversely affect the structural integrity of such containers.

Containers constructed of thermo-plastic substances are increasingly gaining in popularity for packaging fragile food products. However, packaging fragile dry food products utilizing current thermo-plastic container technology is still problematic. While previous efforts have addressed the problems associated with utilizing thermo-plastic containers in packaging liquid products, these efforts have not addressed the inherent problems associated with packaging fragile dry food products. Fragile dry food products (e.g., snack foods, baked goods and cereals) contain significantly larger amounts of entrapped gas, both within their structure as well as in their surrounding packaging, than do liquid products. The effect environmental changes impart on this larger volume of entrapped gas profoundly affects the packaging requirements of fragile dry food products. Currently, thermo-plastic technology offers two basic alternatives for manufacturing plastic containers that adapt to or compensate for changing environmental conditions.

First, by increasing the thickness of the container's sidewall, a thermo-plastic container may be fashioned which is strong enough to resist forces induced by changing environmental conditions. However, such containers are generally undesirable in that they are expensive, in terms of materials, to manufacture and their weight is relatively high. Moreover, they are less environmentally friendly in that their ability to biodegrade is generally more protracted than thinner walled containers.

Alternatively, the thickness of a container's sidewall may be reduced so as to fashion a thermo-plastic container capable of adjusting its shape to changes in environmental conditions like a flexible package, but being sufficiently rigid to offer some protection from outside physical forces. However, such containers have significant commercial drawbacks. While it is currently possible to fashion a relatively thin walled thermo-plastic container that is capable of withstanding expansion forces resulting when the container's interior pressure is greater than the ambient pressure; such thin walled thermo-plastic containers tend to buckle, deform, or implode in a generally unpredictable manner when the interior pressure is less than the ambient pressure (e.g., the vacuum inducing manufacturing process discussed previously). Such deformation or implosion tends to detract from the commercial presentation of the container and often is interpreted as a damaged or defective product by purchasing consumers.

A variety of proposals have previously been made to circumvent the problems inherent in designing thermo-plastic containers capable of adapting to environmental changes. For Example, U.S. Pat. No. 6,074,677 to Croft discloses a composite food container comprised of a vacuum packed inner flexible bag 60 and a rigid plastic tubular outer container 20. While the rigid plastic outer container 20 protects the container's contents, the differential between the vacuum in the inner flexible bag 60 and the vacuum in the region R between the inner bag and the outer container is sufficiently maintained so as to prevent the spoilage of the food product within the inner bag 60. However, such a container is both complicated and relatively expensive to manufacture.

Another prior proposal is U.S. Pat. No. 5,921,429 to Gruenbacher et al. which discloses a substantially rectangular plastic container for multiple, side-by-side stacks of fragile food articles comprised of a single blow molded body. Key to the Gruenbacher et al. '429's design is the inclusion of an internal partition 16 having two spaced apart walls 26 and 28 which are adapted to deform in the presence of vacuum and pressure in the compartments such that the outer perimeter dimension of the container remains substantially the same and the wrap around labeling retains its fit. In addition to requiring a relatively complicated manufacturing process, the Gruenbacher et al. '429 design is not suited to packaging a single stack of fragile food articles.

A need, therefore, exists for an improved blow molded thermoplastic container which is relatively simple to manufacture and strong enough to resist external compressive force, yet capable of adapting to changes in environmental conditions without adversely impacting the commercial presentation of the container.

SUMMARY OF THE INVENTION

The present invention overcomes many of the shortcomings inherent in previous containers for packaging potato chips and/or crisps, corn based chips and/or crisps, cookies and the like. The improved container of the present invention generally comprises a tubular body having a sidewall, a permanently closed end and an opposing hermetically sealable open end. The improved implosion-resistant container of the present invention utilizes a collection of stress dissipating mechanisms that counteract the forces causing deformation, implosion and loss of seal integrity in hermetically sealable thermo-plastic containers. This collection of stress dissipating mechanisms, employed collectively or separately, allows a hermetically sealable container for storing fragile food products to be fashioned as a relatively lightweight, thin-walled blow molded thermo-plastic container that is capable of adapting to changing environmental conditions while maintaining its visual aesthetic appearance.

The improved container of the present invention may include structural rigidity mechanisms that strengthen the structural integrity of hermetically sealed containers so as to withstand forces induced by changes in environmental conditions. In one embodiment, the structural rigidity mechanism may comprise molded ribs and "C" beams in a corrugated pattern traversing the longitudinal axis of the container. Alternatively, randomly spaced three-dimensional figures formed into the sidewall of the thermo-plastic container may also be employed as structural rigidity mechanisms.

The improved container of the present invention may also include a floating panel mechanism that allows a hermetically sealed container to adjust its internal volume in response to changes in environmental conditions without detracting from the commercial presentation of the container. The floating panel mechanism comprises a stable panel area defined by a flexible corrugated suspension ring formed within the confines of a planar surface fashioned in the curved sidewall of the container. The flexible corrugated suspension ring surrounding the stable panel area allows the entire stable panel area to move uniformly without randomly distorting or buckling the container.

The improved container of the present invention may also include a morphing geometries mechanism comprising an annular bellows means is formed in the tubular body of a container and allows a hermetically sealed container to repeatedly increase or decrease its internal volume to counteract changing environmental conditions.

The improved container of the present invention may also include a flowing geometries mechanism that allows a hermetically sealed container to smoothly change its geometry to counteract changes in environmental conditions thereby avoiding the random buckling and deformation inherent in current packaging techniques which detracts from the commercial presentation of the container. Flowing geometries mechanisms typically comprise one or more weakened panel area formed in the sidewall of the container between tubular support structures comprising the container's base and top sections. Flexible hinge areas situated between the weakened panel area and the tubular support structures allow the container to change its internal volume in response to changes in environmental conditions without detracting from the visual aesthetics of the container. The forces generated by changes in environmental conditions are focused on the panel area, which contracts and expands uniformly in response (i.e., the entire panel area flexes in and out in relation to the container sidewall). The panel areas may further comprise a series of parallel V-grooves formed therein, which serve to stiffen the panel area by distributing forces more evenly. The panel area thereby flexes as a unitary panel in a more evenly balanced manner. The panel areas may have either planar or curved cross sections, thereby allowing a wide variety of container designs and shapes.

Thus, the improved container of the present invention may comprise one or more of the aforementioned stress dissipating mechanisms, acting separately or collectively, to counteract the forces induced by changing environmental conditions. Consequently, while the container of the present invention generally comprises at least one stress dissipating mechanisms formed in a generally tubular body, in accordance with the teachings of the present invention, numerous embodiments of hermetically sealable thermo-plastic, blow-molded containers are possible.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE DRAWINGS

The container of the present invention utilizes a collection of stress dissipating mechanisms that counteract the forces induced by changes in environmental conditions which cause deformation, implosion and loss of seal integrity in hermetically sealed containers. This collection of stress dissipating mechanisms allows a hermetically sealable container for storing fragile food products to be fashioned as a relatively lightweight, thin-walled blow molded thermo-plastic container that is capable of adapting to changing environmental conditions while maintaining its visual aesthetic appearance. The stress dissipating mechanisms employed are adaptable to container designs generally well known in the art. Thus, the various embodiments of the container of the present invention all have a generally tubular body comprising a sidewall permanently closed at one end comprising the container's base and having a hermetically sealable cap or lid. While employed collectively and/or separately, depending upon the circumstances of a specific product and its packaging requirements, the collection of stress dissipating mechanisms utilized in containers of the present invention may best be understood by examining each stress dissipating mechanism in isolation.

Structural Rigidity Mechanisms

Figure 1A:
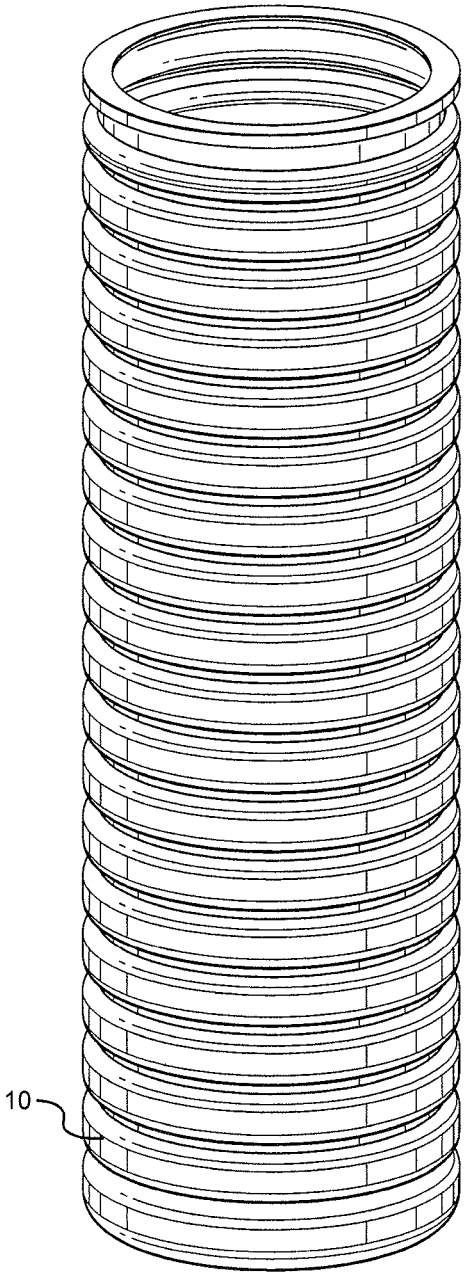
FIGS. 1*a*, 1*b*, 2*a*, and 2*b* are perspective views of alternative embodiments of container of the present invention illustrating the employment of corrugated sides to induce structural rigidity.
Figure 1B:
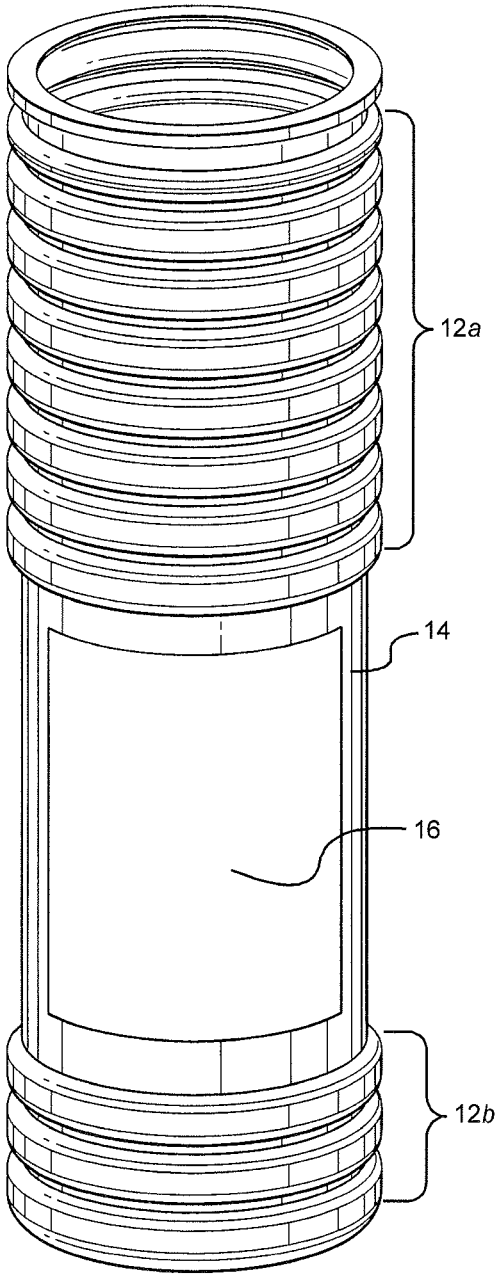
Figure 2A:
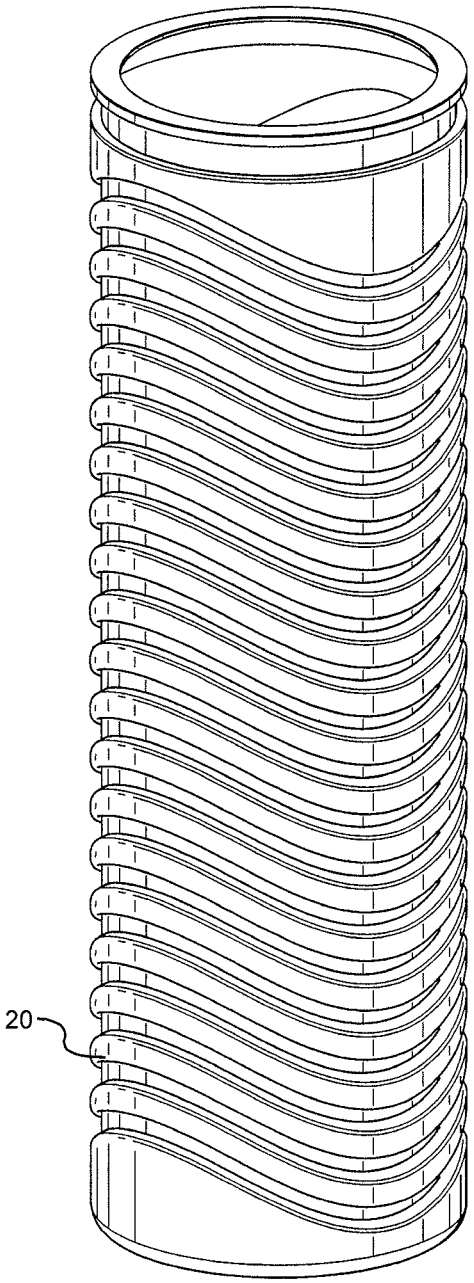
Figure 2B:
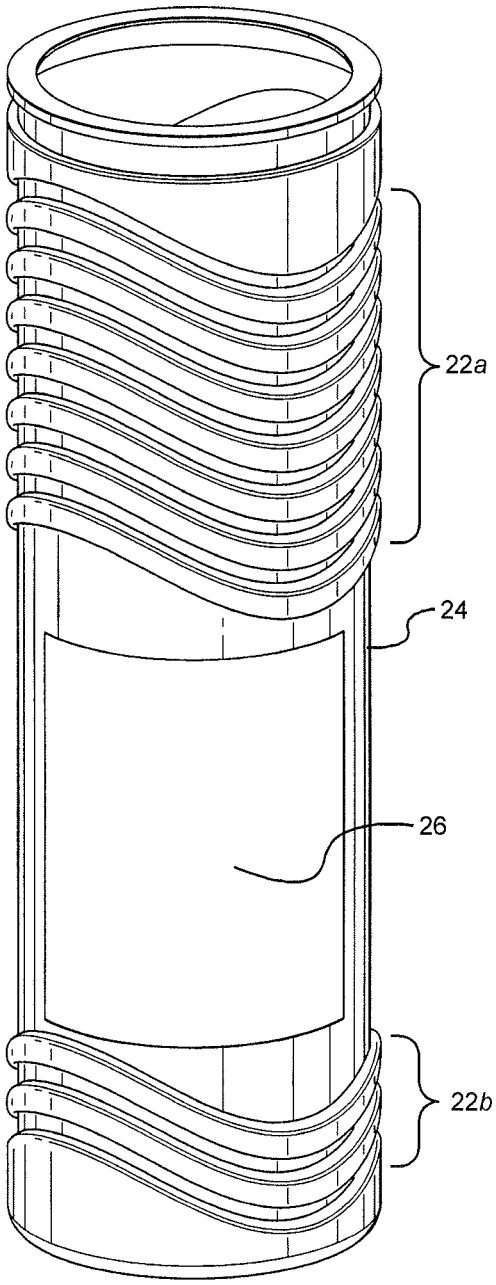
Figure 4A:
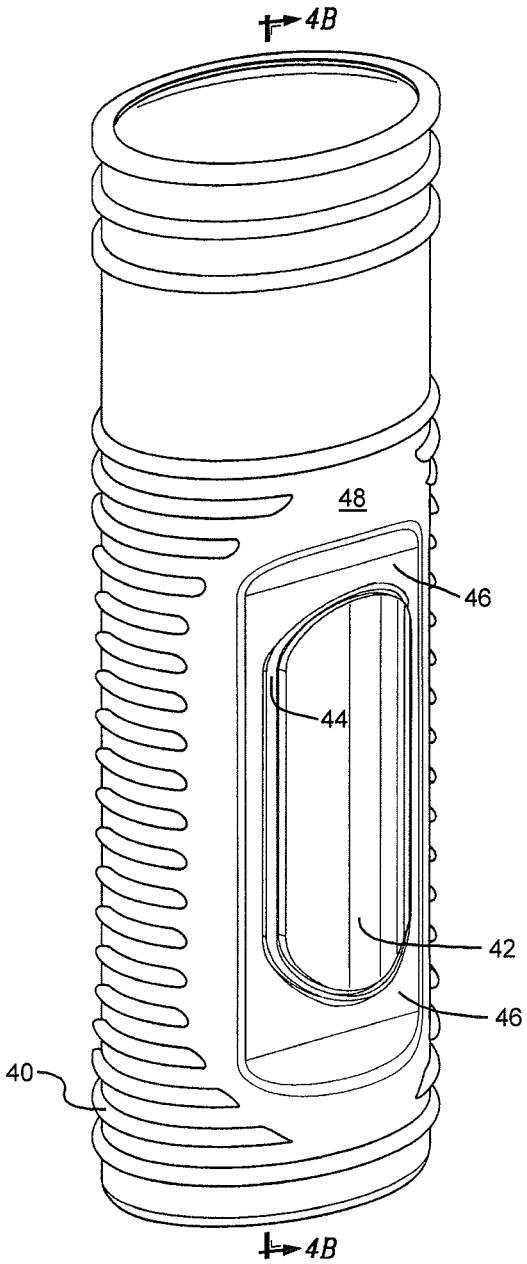
FIG. 4*a* is a perspective view of the container of the present invention illustrating the employment of a floating panel mechanism.

Referring to FIGS. 1*a*, 1*b*, 2*a*, 2*b* and 4*a*, the use of molded ribs and "C" beams in a corrugated pattern traversing the longitudinal axis of the container may be employed to provide added strength throughout the container. Compressive and expansive forces are distributed over a larger area thereby resulting in a more structurally rigid container. The molded ribs and corrugated "C" beams may be either annular or non-annular. Thus, as illustrated in FIGS. 1*a* and 1*b*, the corrugated "C" beams 10 are generally annular and perpendicular to the longitudinal axis of the container. As illustrated in FIGS. 2*a* and 2*b*, the corrugated "C" beams 20, while generally annular, may also traverse about the longitudinal axis of the container in a wavy sinusoidal pattern. Alternatively, as shown in FIG. 4*a*, non-annular ribs 40 may be formed into selected areas of a container.

Where applicable, the container may also include a smooth surface area between corrugated sections. Thus, as illustrated in FIG. 1*b*, an upper corrugated section 12*a* and the lower corrugated section 12*b* may be separated by a smooth section 14 that is suitable for attaching a label 16. Similarly, as illustrated in FIG. 2*b*, a smooth section 24 that is suitable for attaching a label 26 may separate the upper wavy corrugated section 22*a* and the lower wavy corrugated section 22*b*.

Figure 3:
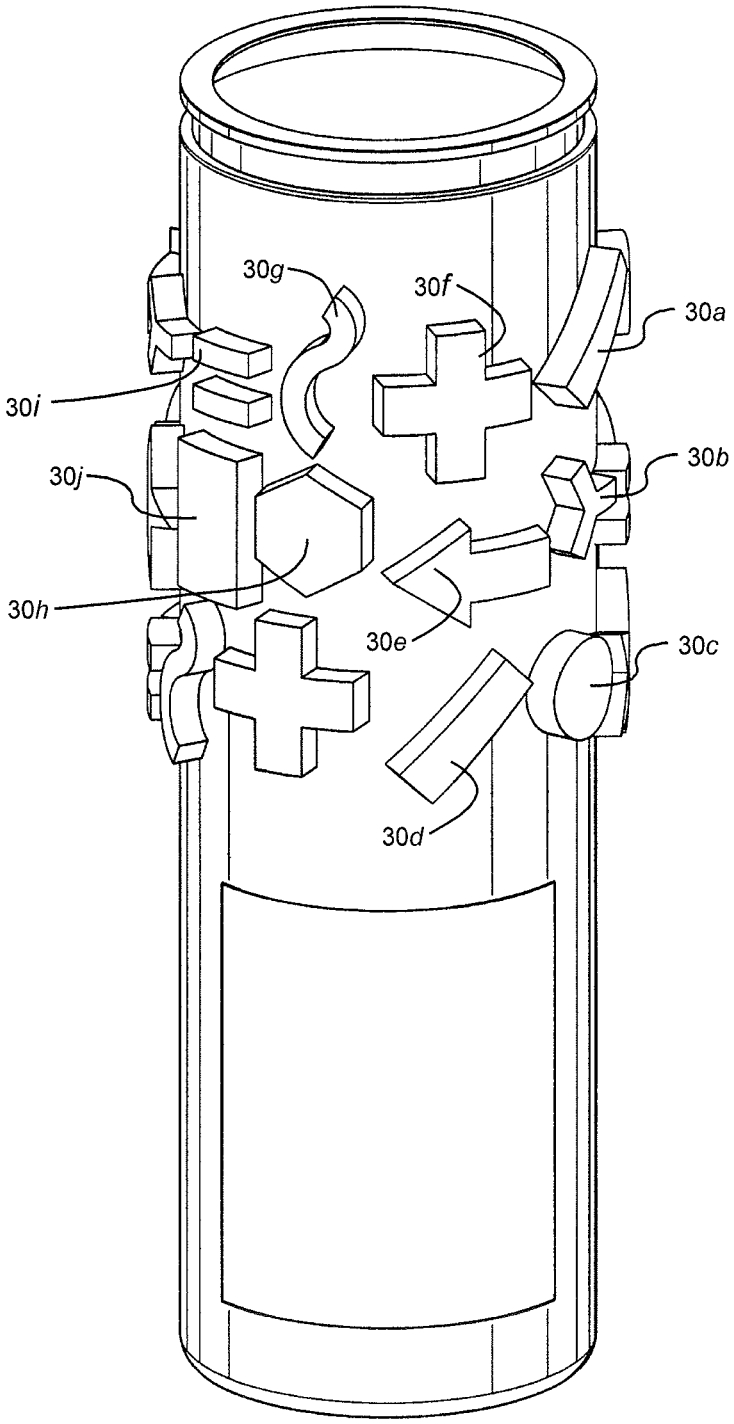
FIG. 3 is a perspective view of the container of the present invention illustrating the employment of three-dimensional shape molding to induce structural rigidity.

Referring now to FIG. 3, randomly spaced three-dimensional FIGS. 30*a-j* formed into the sidewall of a thermo-plastic container may also be employed to provide added strength throughout the container. The randomly spaced three-dimensional FIGS. 30*a-j* distribute compressive and expansive forces over a larger area thereby resulting in a more structurally rigid container. It is understood that the geometric three-dimensional FIGS. 30*a-j* illustrated in FIG. 3 are shown to merely illustrate the concept and not to limit it. Thus, any three-dimensional figure design formed into the sidewall of a thermo-plastic container may be suitable in the appropriate circumstance. Additionally, the three-dimensional figures may also be evenly spaced for aesthetic purposes.

Floating Panel Mechanism

Figure 4B:
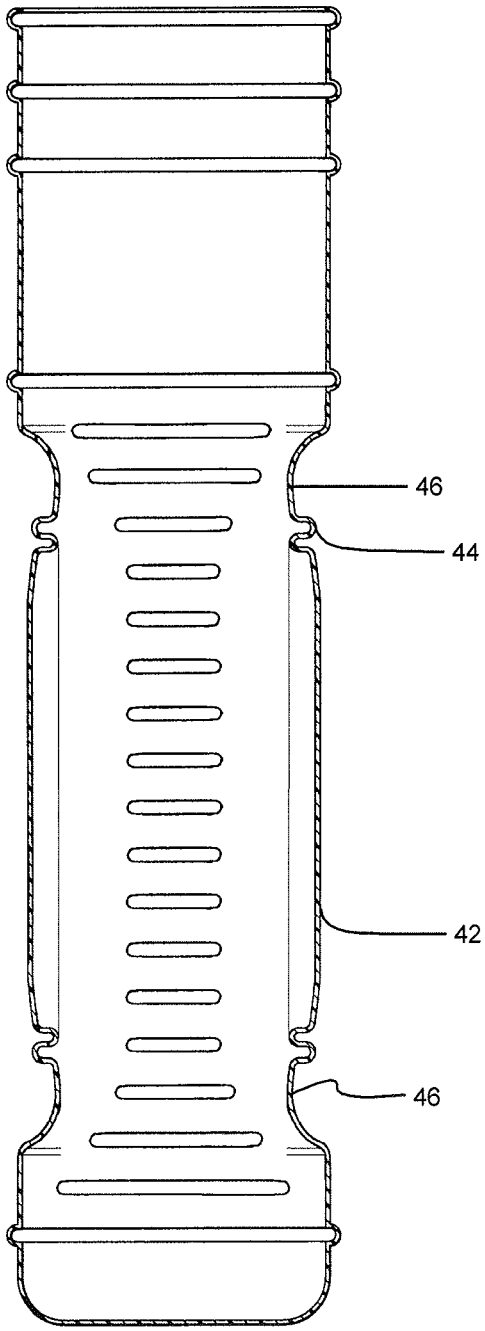
FIG. 4*b* is a cross-sectional view of the container of the present invention illustrating the employment of a floating panel mechanism.

Referring now to FIGS. 4*a* and 4*b*, an embodiment of a hermetically sealable container of the present invention is shown which illustrates the utilization of a floating panel mechanism. The floating panel mechanism comprises a stable panel area 42 defined by an encompassing flexible corrugated suspension ring 44 formed within the confines of a planar surface 46 fashioned in the curved sidewall 48 of the container. The flexible corrugated suspension ring 44 surrounding the stable panel area 42 allows the entire stable panel area 42 to move uniformly (i.e., spring in and out) without randomly distorting or buckling the container. Other portions of the container may be sufficiently reinforced (e.g., using structural rigidity mechanisms such as corrugated ribs 40) so that when the container is hermetically sealed, all container expansion and contraction in response to changes in environmental conditions is accomplished by the floating panel mechanism. The stable panel area 42 springs out and retracts in a direction perpendicular to the planar surface 46. Thus, changes in the internal gas volume induced by changes in environmental conditions may be accommodated without detracting from the commercial presentation of the container.

Morphing Geometries Mechanism

Figure 5A:
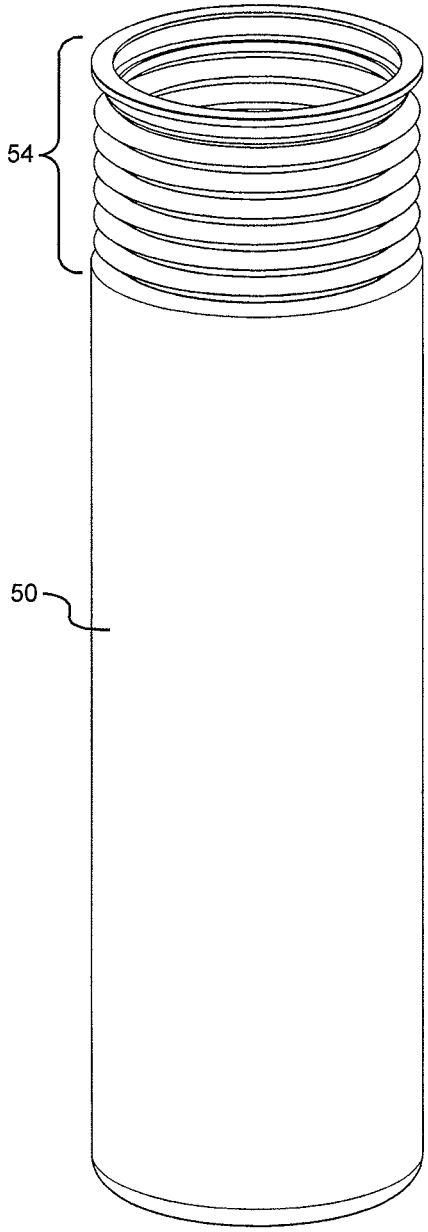
FIGS. 5*a* and 5*b* are perspective views of the container of the present invention illustrating the employment of a morphing geometries mechanism.
Figure 5B:
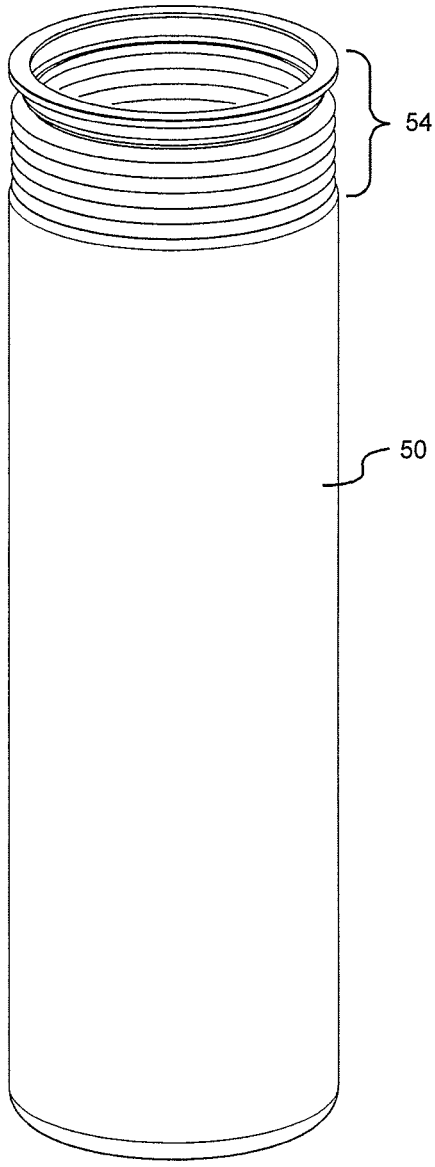

Referring now to FIGS. 5*a* and 5*b*, an example of a container is shown which illustrates the utilization of a morphing geometries mechanism. The structure of a morphing geometries mechanism comprises an annular bellows means 54 formed in the tubular body 50 of the container. The annular bellows means 54 expands (shown in FIG. 5*a*) and contracts (shown in FIG. 5*b*) along the container's longitudinal axis allowing a hermetically sealed container to repeatedly increase or decrease its internal volume to counteract changing environmental conditions. While the example illustrated in FIGS. 5*a* and 5*b* positions the annular bellows means 54 near the top of the container's tubular body, it is understood that in appropriate circumstances, the annular bellows means 54 may be positioned anywhere along the entire longitudinal length of the container's tubular body.

Flowing Geometries Mechanism

Figure 6A:
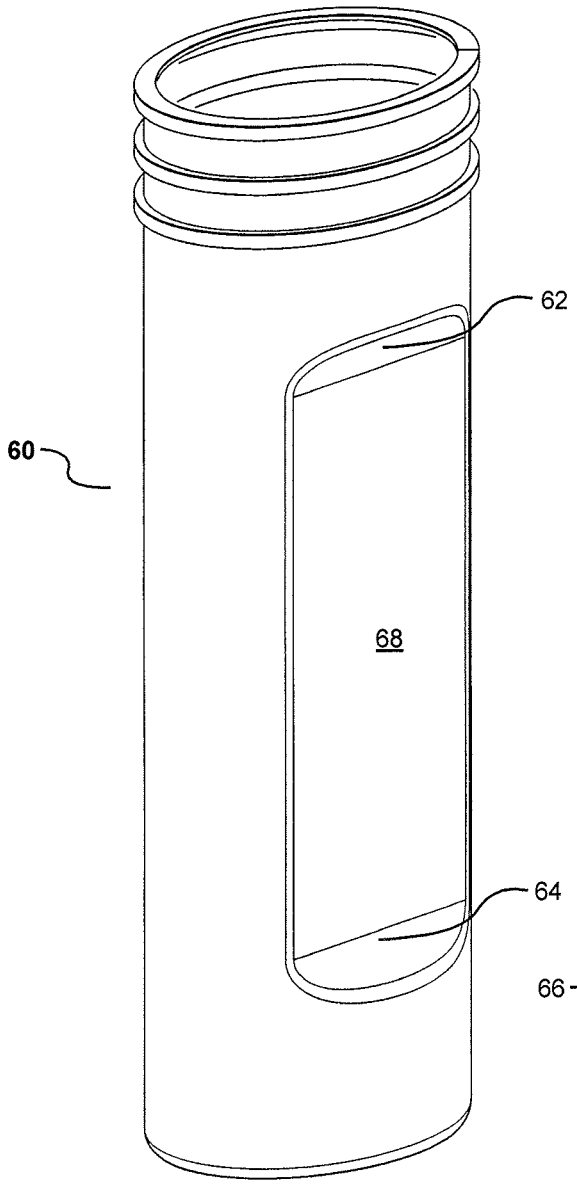
FIG. 6*a* is a perspective view of the container of the present invention illustrating the employment of a flowing geometries mechanism.
Figure 6B:
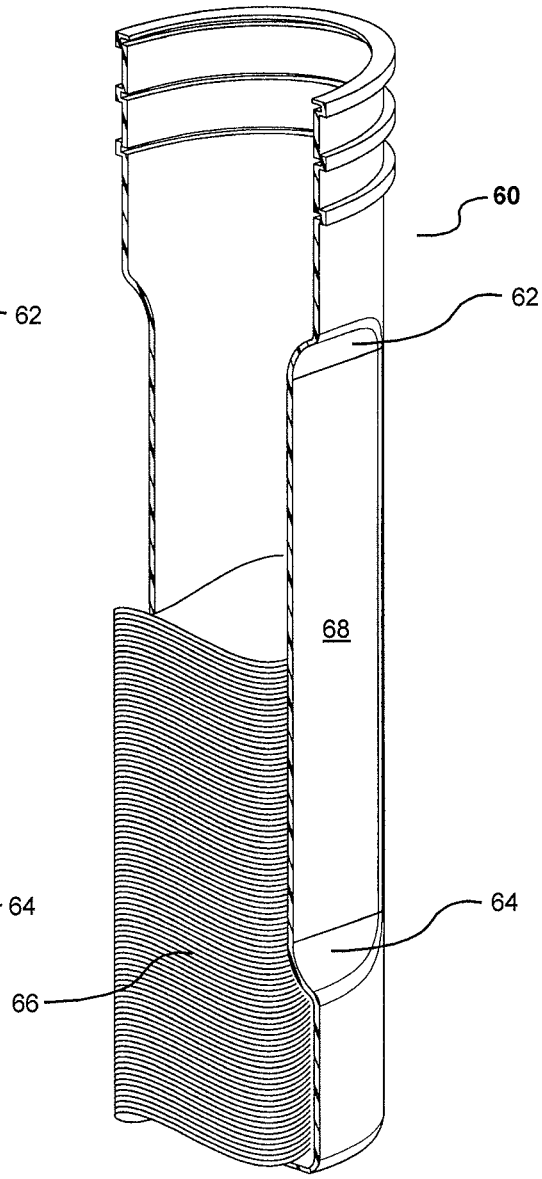
FIG. 6*b* is a cut-away perspective view of the container of the present invention illustrating the employment of a flowing geometries mechanism.

Referring now to FIGS. 6*a* and 6*b*, an embodiment of a container of the present invention is shown which illustrates the utilization of a flowing geometries mechanism. Flowing geometries mechanisms are designed so as to allow a hermetically sealed container to smoothly change its geometry to counteract changes in environmental conditions thereby avoiding the random buckling and deformation inherent in current packaging techniques which detracts from the commercial presentation of the container.

For example, in the container shown in FIGS. 6*a* and 6*b*, the flowing geometries mechanism comprises one or more lateral flexible hinge areas (e.g., 62 and 64) formed in the sidewall of the container 60 and defining a weakened panel area 68 situated there between. The lateral flexible hinge areas 62 and 64 effectively control the deformation of a hermetically sealed container in response to changes in environmental conditions by allowing the sealed container to flex (i.e., contract and expand) the weakened panel area 68 in a smooth and uniform manner. While the container's geometry or shape is allowed to smoothly adjust to changes in environmental conditions, the deformation is controlled such that the commercial presentation of the container is not detracted from.

Figure 6C:
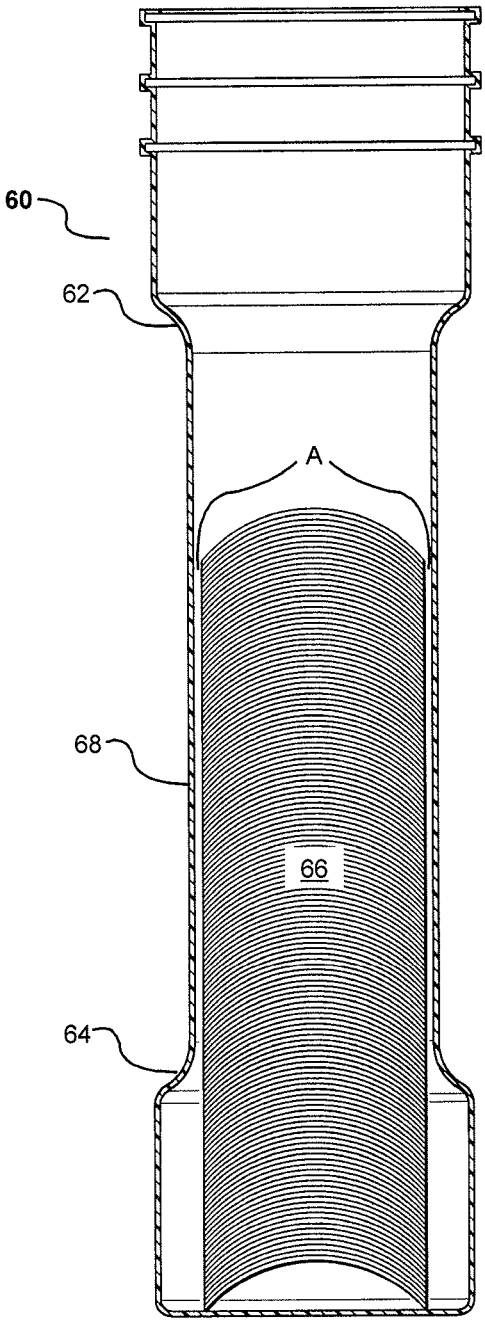
FIGS. 6*c* and 6*d* are cross-sectional views of the container of the present invention illustrating the employment of amorphing geometries.
Figure 6D:
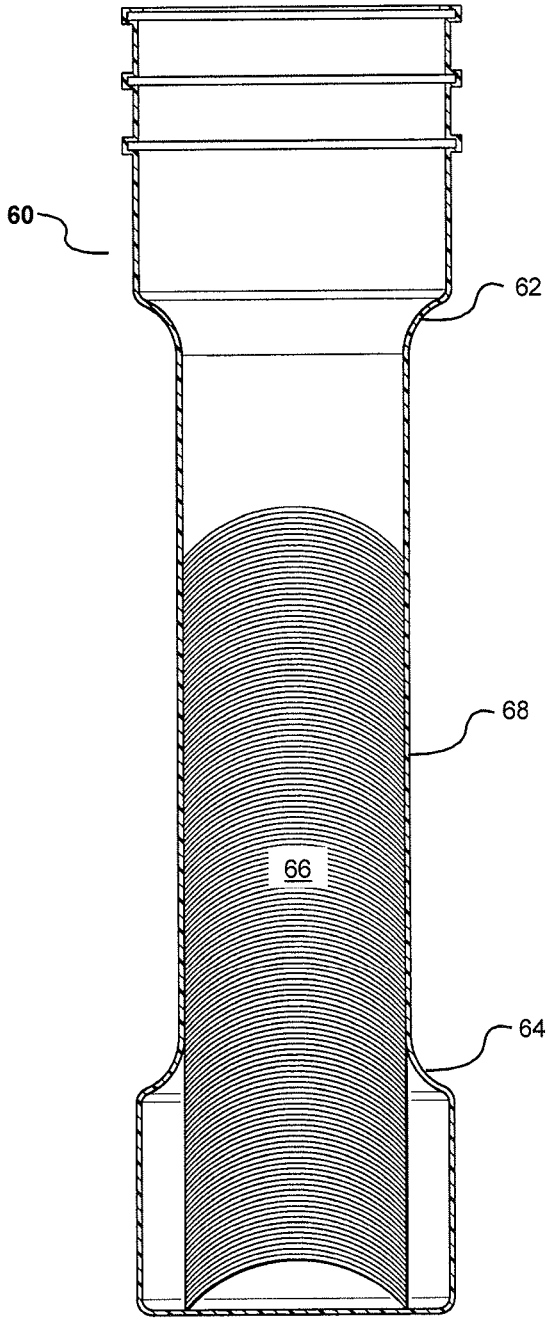

Referring now to FIGS. 6*c* and 6*d*, as illustrated in longitudinal cross-sectional views of the container 60 shown in FIGS. 6*a* and 6*b* the container 60 is designed so that a small annular space (generally designated as A) exists between the outer periphery of the enclosed product stack 66 and the planar weakened panel area 68 of the container 60 so as to aid in the manufacturing and packaging process. The size of the container 60 may be designed such that when hermetically sealed, the inner wall of the weakened panel area 68 may contact the outer periphery of the enclosed product stack 66 when the container 60 contracts, thereby limiting the amount of controlled deformation. The enclosed product stack 66 may actually provide some measure of lateral structural support to the sidewall of the hermetically sealed container 60 when the internal pressure of the container 60 is less than the ambient atmospheric pressure.

Figure 7A:
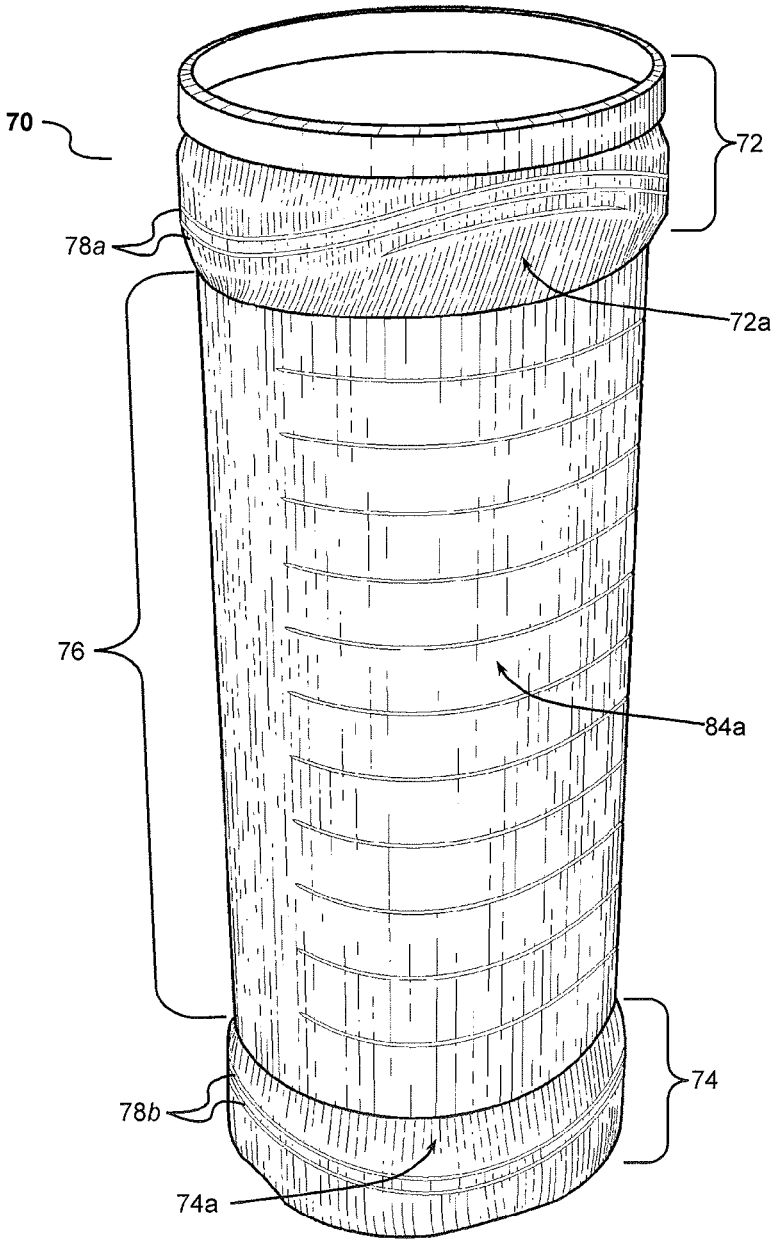
FIG. 7*a* is a perspective view of a preferred embodiment of the container of the present invention illustrating the employment of a flowing geometries mechanism which includes a curved weakened panel area having parallel V-grooves formed therein.

While the lateral cross-section of the weakened panel area 68 in the embodiment of the container 60 illustrated in FIGS. 6*a*-6*d*, is generally planar (i.e., flat), flowing geometries mechanisms may also comprise panel areas having a curved lateral cross-section. For example, in a preferred embodiment of the container of the present invention shown in FIGS. 7*a*, 7*b* and 7*c*, a flowing geometries mechanism is illustrated which comprises a panel area 84 having a curved lateral cross section. As illustrated in FIG. 7*a*, the container 70 comprises a generally tubular body that is permanently closed at its lower end forming the container's base and having a sealable upper end. The tubular body of container 70 is comprised of a sidewall having three contiguous sections: a permanently closed lower base section 74, a middle section 76 and a sealable upper section 72. While the lateral cross-sections of the lower base section 74 and the upper section 72 are generally circular, the lateral cross-section of the middle section 76 is generally oval. In order to properly focus the forces induced by changes in environmental conditions on the flowing geometries mechanism, the lower base section 74 and the upper section 72 are designed to be generally more rigid in maintaining their cross-sectional shape than the middle section 76. For example, the lower base section 74 and the upper section 72 may include structural rigidity mechanisms such as annular corrugated "C" beams 78*a*, 78*b* which traverse about the longitudinal axis of the container in a wavy sinusoidal pattern.

The lower base section 74 and the upper section 72 also include transitional areas 74*a*, 72*a*, respectively, wherein the generally circular lateral cross-section of the lower base section 74 and the upper section 72 transition to a generally oval cross-section of the middle section 76. These transitional areas 74*a*, 72*a* effectively act as flexible hinge areas to effectively control the deformation of the container in response to changes in environmental conditions.

Figures 7B, 7C:
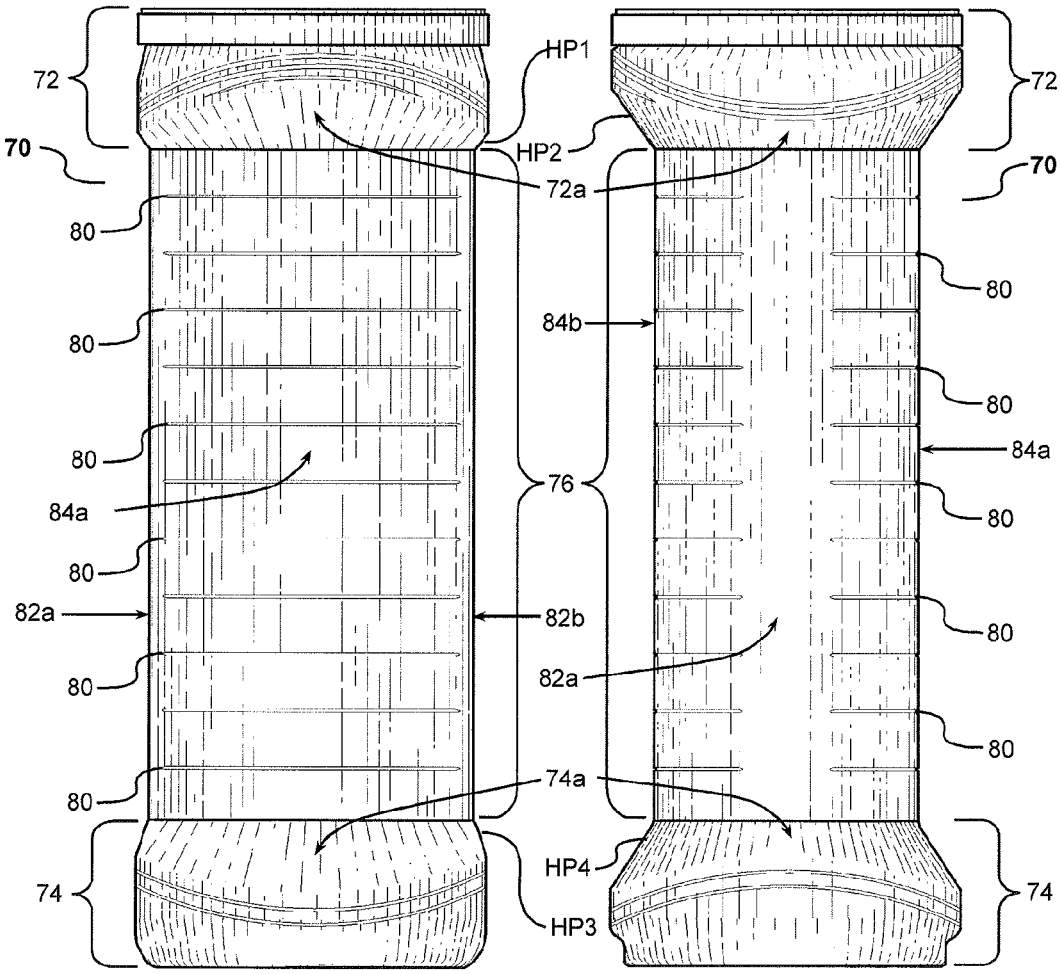
FIGS. 7*b* and 7*c* are side views of the preferred embodiment of the container of the present invention shown in FIG. 7*a;*

Referring now to FIG. 7*b*, which depicts a side view of the container 70, and to FIG. 7*c*, which depicts a side view of the container 70 shown in FIG. 7*b* rotated ninety degrees about its longitudinal axis, the middle section 76 of container 70 includes a plurality of parallel grooves 80 formed in the sidewall of the middle section 76. In one embodiment, the grooves may have a "V" shaped cross section, wherein the nadir of the "V" shape is oriented towards the interior of the container 70. The grooves 80 are non-annular and generally evenly spaced along the longitudinal axis of the container 70. Moreover, the grooves 80 are generally identical in dimension and vertically aligned, such that the middle section 76 of container 70 is roughly divided into longitudinal portions or sections which contain parallel grooves 80 and longitudinal portions or sections which are smooth.

For example, as shown in the side views of container 70 illustrated in FIGS. 7*b* and 7*c*, the middle section 76 is divided into two longitudinal sections 84*a*, 84*b* having parallel grooves 76 formed therein and two longitudinal sections 82*a*, 82*b* which are essentially smooth. The traverse width of the grooved longitudinal sections 84*a*, 84*b*, are typically larger than the traverse width of the smooth longitudinal sections 82*a*, 82*b*. The grooves 80 on the exterior surface of the container 70 effectively form ribs on the interior periphery of the container 70. Thus, as structural rigidity mechanisms, the parallel grooves 80 serve to stiffen the grooved longitudinal sections 84*a*, 84*b*, thereby distributing the compressive and expansive forces more evenly over the entire longitudinal section, enabling the container to smoothly change its geometry to counteract changes in environmental conditions and avoid the random point buckling and deformation.

As the various longitudinal sections 82*a*, 82*b*, 84*a*, 84*b* expand and contract, the transitional areas 74*a*, 72*a* flex to accommodate the changes in cross sectional area. However, the structural rigidity mechanisms 78*a*, 78*b* in the upper section 72 and lower base section 74 serve to isolate the flexing from their respective distal ends. Thus, the generally circular cross-section of the bottom of the lower base section 74 remains intact. Similarly, the generally circular cross-section of the top of the upper section 72 remains essentially unchanged. Thus, any hermetic seal applied to the rim or top of the upper section 72 remains intact.

The transitional areas 74*a*, 72*a* may comprise differing hinge profiles, which accommodate more or less flexing in accordance with the design of a container. For example, as illustrated in FIGS. 7*b* and 7*c*, the container 70 includes smaller hinge profiles (e.g., HP3 and HP1) in sections of the transitional areas 74*a*, 72*a* which correspond to or are aligned with the smooth longitudinal sections 82*a*, 82*b*. Correspondingly, the container 70 includes larger hinge profiles (e.g., HP4 and HP2) in sections of the transitional areas 74*a*, 72*a* which correspond to or are aligned with the grooved longitudinal sections 84*a*, 84*b*. Thus, the preferred embodiment of the container 70 shown in FIGS. 7*a*, 7*b* and 7*c*, is designed to accommodate more flexing in the transitional areas 74*a*, 72*a* which correspond to or are aligned with the grooved longitudinal sections 84*a*, 84*b*.

Figures 8A, 8B, 8C:
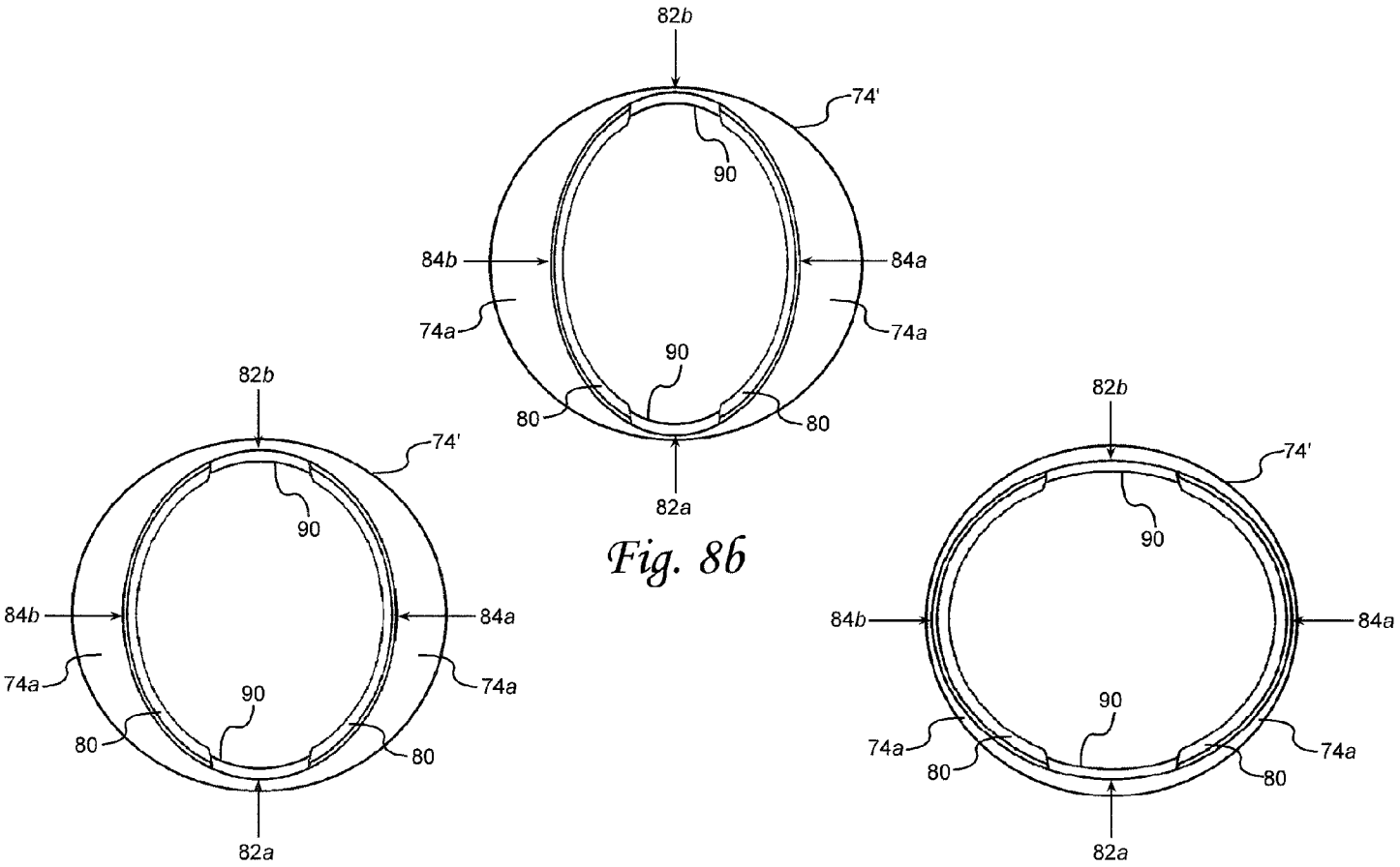
FIGS. 8*a*, 8*b* and 8*c* are cross-sectional views of the preferred embodiment of the container of the present invention shown in FIG. 7*a* along line 8-8, illustrating the employment of a flowing geometries mechanism which includes a curved weakened panel area having parallel V-grooves formed therein.

Referring now to FIGS. 8*a*, 8*b* and 8*c*, cross-sectional views of the preferred embodiment of the container 70 shown in FIGS. 7*a*, 7*b* and 7*c*, are shown in a variety of environmental conditions. As noted previously, the lateral cross-sections of the lower base section 74 and the upper section 72 are generally circular, while the lateral cross-section of the middle section 76 is generally oval. Correspondingly, the outer periphery 74' of lower base section 74 is generally circular. The lower base section 74, as well as the upper section 72, is designed to be generally more rigid in maintaining its cross-sectional shape than the middle section 76. Thus, as depicted in the three environmental conditions illustrated in FIGS. 8*a*, 8*b* and 8*c*, the outer periphery of the lower base section 74' generally maintains its circular shape proportion regardless of the environmental condition.

The parallel grooves 80 formed in the sidewall of the middle section 76 effectively form ribs on the interior periphery surface 90 of the container 70. The preferred embodiment of the container shown in FIGS. 7*a-c* and 8*a-c* also depicts the middle section 76 as being divided into two longitudinal sections 84*a*, 84*b*, which have parallel grooves 76 formed therein, and two longitudinal sections 82*a*, 82*b*, which are essentially smooth.

The lower base section 74 also includes a transitional area 74*a* wherein the generally circular lateral cross-section of the lower base section 74 transitions to a generally oval cross-section of the middle section 76. As noted previously, this transitional area 74*a* effectively acts as flexible hinge area to effectively control the deformation of the container in response to changes in environmental conditions. As illustrated in FIGS. 8*a*, 8*b* and 8*c*, the transitional area 74*a* may comprise differing hinge profiles, which accommodate more or less flexing in accordance with the design of a container. Thus, as illustrated, the container 70 includes smaller hinge profiles (e.g., HP3) in sections of the transitional areas 74*a* which correspond to or are aligned with the smooth longitudinal sections 82*a*, 82*b*. Correspondingly, the container 70 includes larger hinge profile (e.g., HP4) in the sections of the transitional areas 74*a* which correspond to or are aligned with the grooved longitudinal sections 84*a*, 84*b*. Thus, the preferred embodiment of the container 70 shown in FIGS. 7*a-c* and 8*a-c* is designed to accommodate more flexing in the transitional areas 74*a* which correspond to or are aligned with the grooved longitudinal sections 84*a*, 84*b*.

FIG. 8*a* illustrates (in somewhat exaggerated form, not necessarily to scale) a lateral cross-sectional view of the container 70 in essentially a steady state environmental condition (i.e., where the internal pressure is equal to the external pressure). The lateral cross-sectional view of the outer periphery of the lower base section 74' is generally circular while the lateral cross-sectional view of the middle section 76 comprised of the grooved longitudinal sections 84*a*, 84*b* and the smooth longitudinal sections 82*a*, 82*b* are generally oval.

FIG. 8*b* illustrates (in somewhat exaggerated form, not necessarily to scale) the effect of a high pressure environmental condition (i.e., the external pressure is higher than the internal pressure) on the lateral cross-section of the container 70 (e.g., after completion of the manufacturing process when partial vacuum is induced). Under such an environmental condition, the grooved longitudinal sections 84*a*, 84*b* are drawn inward and the smooth longitudinal sections 82*a*, 82*b* are pushed outward. The transitional area 74*a* flexes so as to accommodate the changing cross sectional dimensions of middle section 76 without affecting the cross-sectional dimension of the periphery 74' of lower base section 74.

FIG. 8*c* illustrates (in somewhat exaggerated form, not necessarily to scale) the effect of a low pressure environmental condition (i.e., the external pressure is lower than the internal pressure) on the lateral cross-section of the container 70. Under such an environmental condition, the grooved longitudinal sections 84*a*, 84*b* expand outward and the smooth longitudinal sections 82*a*, 82*b* are draw inward. The transitional area 74*a* flexes so as to accommodate the changing cross sectional dimensions of middle section 76 without affecting the cross-sectional dimension of the periphery 74' of lower base section 74.

Thus, changes in environmental conditions are compensated for in the middle section 76 and the transitional area 74*a*, 72*a*, correspondingly isolating the distal ends of the container 70 from any distorting effects in response to changes in environmental conditions. Thus, any hermetic seal applied to the rim or top of the upper section 72 remains intact. Similarly, the generally circular cross-section of the bottom of the lower base section 74 generally maintains its circular dimensions. Furthermore, the deformation of the middle section 76 in response changes in environmental conditions is controlled by distributing the compressive and expansive forces more evenly over each longitudinal sections. Thus, the container of the present invention is capable of smoothly altering its geometry to counteract changes in environmental conditions and while maintaining its visual aesthetic appearance by avoiding random point buckling and deformation.

While the preferred embodiment of the container of the present invention shown in FIGS. 7*a-c* and 8*a-c*, utilizes two of the aforementioned stress dissipating mechanisms (i.e., structural rigidity mechanisms and flowing geometries mechanisms) in combination with one another to fashion a container that is capable of adapting to changing environmental conditions while maintaining its visual aesthetic appearance, numerous other combinations of the various aforementioned stress dissipating mechanisms are possible.

For example, as shown in FIGS. 9*a-c* and FIG. 10, in another preferred embodiment of the container of the present invention, structural rigidity mechanisms are used in combination with a multi-faceted sidewall comprised of a plurality of flowing geometries mechanisms having planar weakened panel area. The tubular body of the container 90 is comprised of a sidewall having essentially three contiguous sections: a permanently closed lower base section 94, a middle section 96 and a sealable upper section 92.

The tubular body of container 90 includes a plurality of flowing geometries mechanisms formed in the sidewall of the container between two tubular support structures which comprise the container's base and upper sections 94, 92, respectively. The lower base section 94 and the upper section 92 have a generally circular lateral cross-sections. Correspondingly, the outer periphery 94' of lower base section 94 is also generally circular.

In order to properly focus the forces induced by changes in environmental conditions on the flowing geometries mechanism, the two tubular support structures, (i.e., lower base section 94 and the upper section 92) are designed to be generally more rigid in maintaining their dimensional shape than the middle section 96. The tubular support structures may include structural rigidity mechanisms (e.g., molded ribs or "C" beams) which serve to strengthen the structural integrity of the container and channel forces induced by changes in environmental conditions to the flowing geometries mechanism. For example, in the present instance, the upper section 92 includes a structural rigidity mechanism in the form of an annular groove 98*a* which traverses about the longitudinal axis of the container in a wavy sinusoidal pattern.

The middle section 96 is a multi-faceted sidewall comprised of a plurality of adjacently positioned flowing geometries mechanisms formed therein. Each of the flowing geometries mechanisms is comprised of a planar weakened panel area (e.g., 96*a*, 96*b*, 96*c*), each of which is connected to the lower base section 94 and the upper base section 92 by lateral flexible hinge areas (e.g., 94*a*, 94*b*, 94*c* (not shown) and 92*a*, 92*b*, 92*c*, respectively) formed in the lower base section 94 and the upper section 92. The lateral flexible hinge areas (i.e., 94*a*, 94*b*, 94*c* (not shown) and 92*a*, 92*b*, 92*c*) allow the weakened panel areas (i.e., 96*a*, 96*b*, 96*c*) to flex in response to changes in environmental conditions thereby allowing the sealed container to contract and expand its internal volume in a smooth and uniform manner. While the container's volumetric geometry or shape is allowed to smoothly adjust to changes in environmental conditions, the deformation is controlled so as not to detract from the container's commercial presentation.

The flowing geometries mechanisms effectively isolate the distal ends of the lower base section 94 and the upper section 92 from distortion forces imparted on the container, which are induced in response to changes in environmental conditions. Thus, any hermetic seal applied to the rim or top of the upper section 92 remains intact. Similarly, the generally circular cross-section of the bottom of the lower base section 94 generally maintains its circular dimensions. Furthermore, by distributing the compressive and expansive forces more evenly over the plurality of flowing geometries mechanisms, the deformation of the middle section 96, which counteracts changes in environmental conditions, is more controlled and balanced. Thus, the container 90 of the present invention smoothly alters its geometry to compensate for changes in environmental conditions, while maintaining its visual aesthetic appearance by avoiding random point buckling and deformation.

Figure 9A:
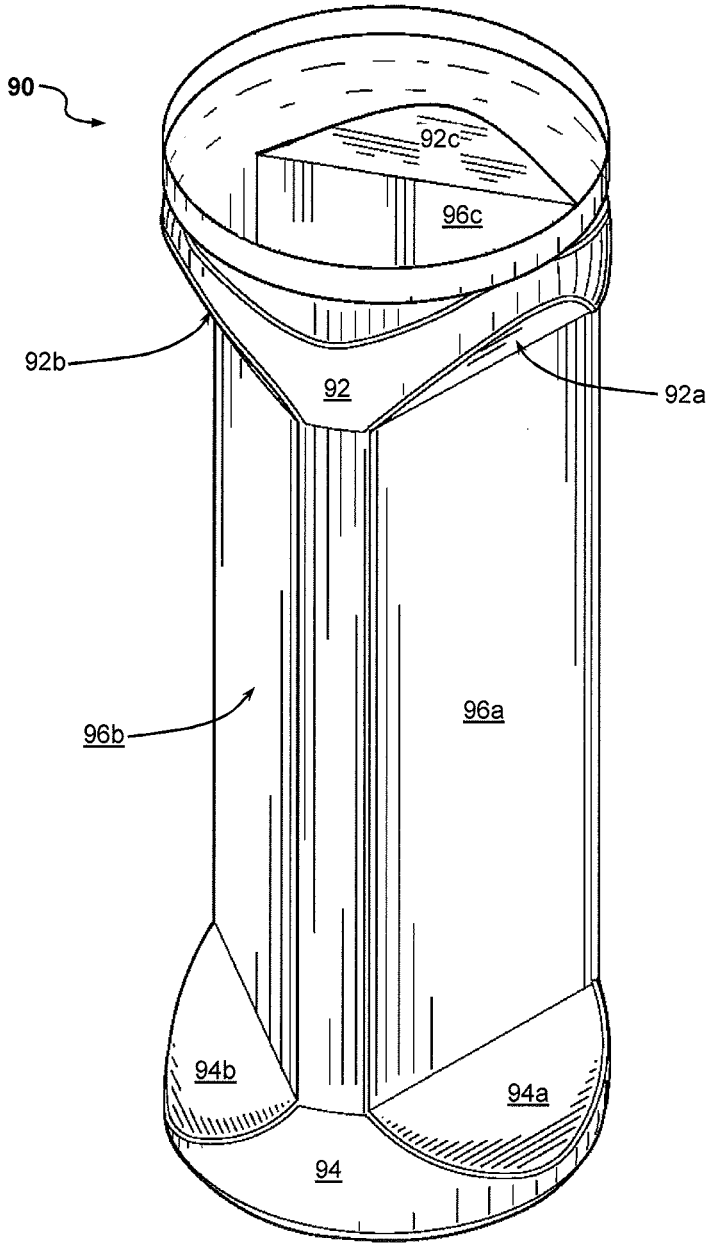
FIG. 9*a* is a perspective view of another preferred embodiment of the container of the present invention illustrating the employment of a flowing geometries mechanism which includes a planar weakened panel area formed therein.
Figure 9B:
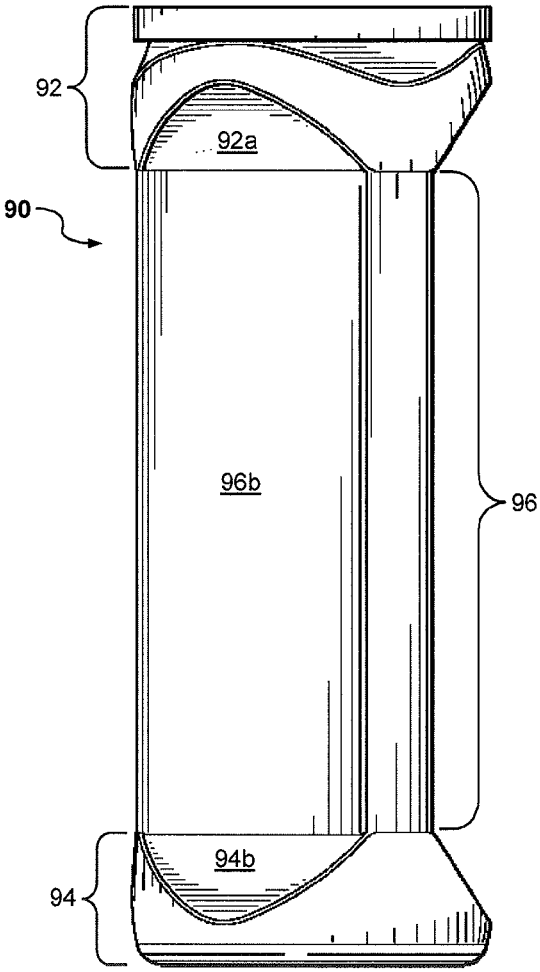
FIGS. 9*b* and 9*c* are side views of the preferred embodiment of the container of the present invention shown in FIG. 9*a*, illustrating the employment of a flowing geometries mechanism which includes a planar weakened panel area.
Figure 9C:
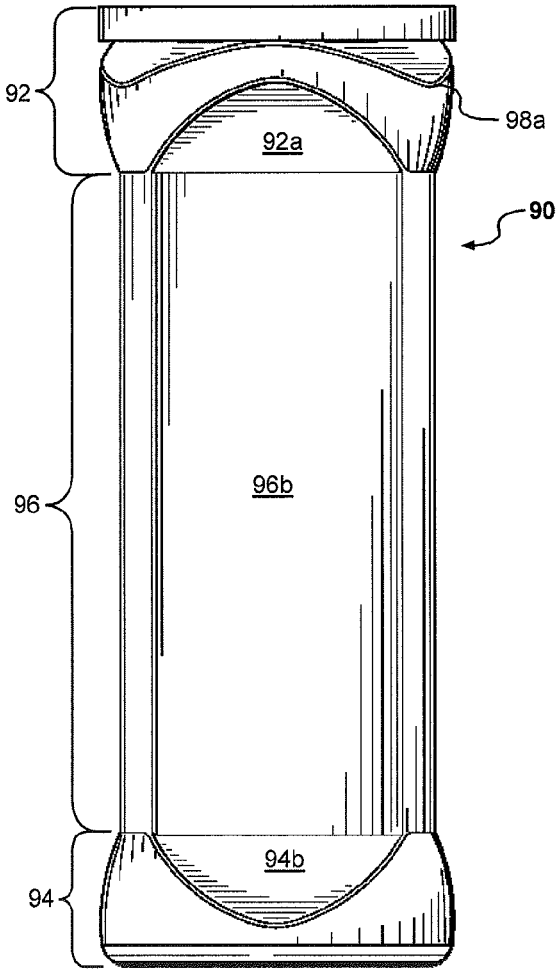
Figure 10:
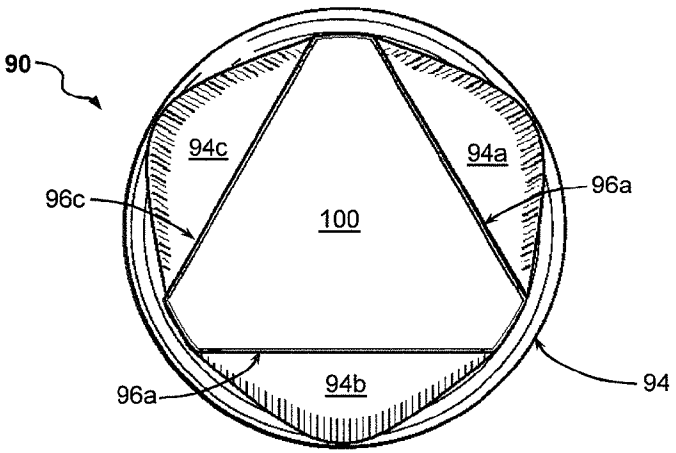
FIG. 10 is a cross-sectional view of the preferred embodiment of the container of the present invention shown in FIG. 9*a* along line 10-10.
Figure 116:
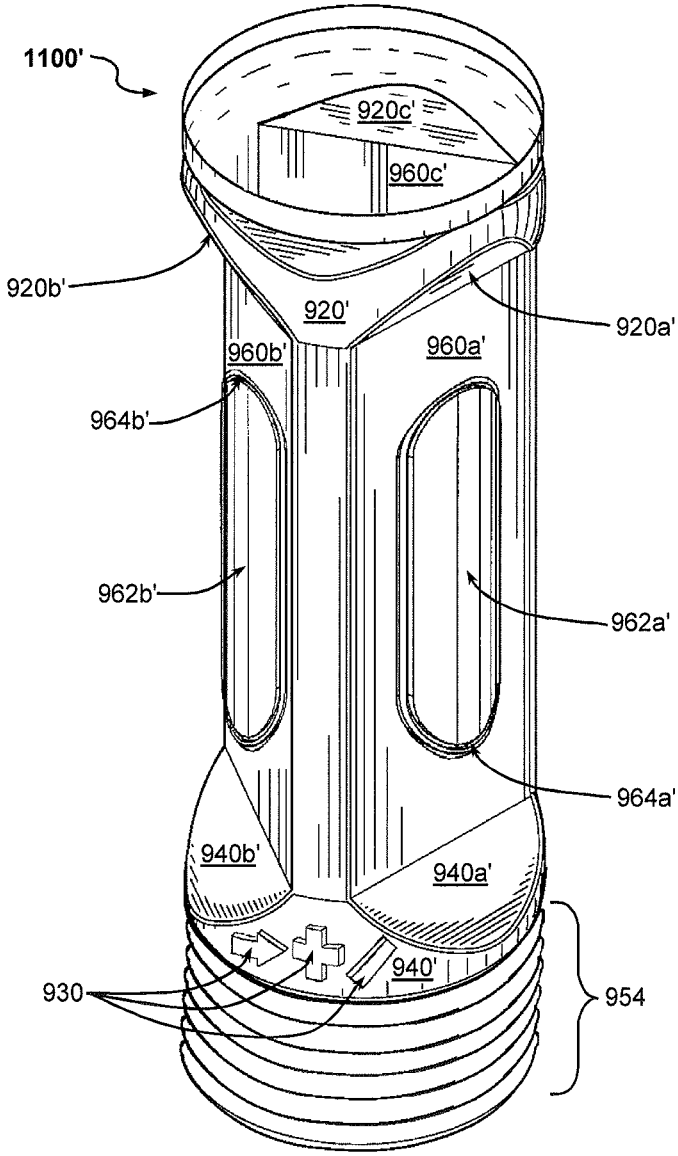

Referring once again to FIGS. 9*a-c*, and particularly in FIG. 10 wherein a lateral cross-sectional view of the middle section 96 is depicted, while the middle section 96 of the preferred embodiment of the container 90 includes three adjacently positioned flowing geometries mechanisms that bound an interior space 100 in a generally triangular configuration, the present invention also envisions containers having more than three flowing geometries mechanisms. For example, a container may comprise a middle section 96 having a lateral cross section that is generally quadrangular, pentagonal, or hexagonal, etc., depending upon the number of adjacently positioned flowing geometries mechanisms used. In addition, the lateral cross sectional geometry of the middle section 96 of a container may be dimensioned so as to correspond with the lateral cross sectional geometry of an enclosed product stack. Moreover, as noted previously and illustrated in FIGS. 6*a* and 6*b*, such a container may be designed so that a small annular space exists between the outer periphery of the enclosed product stack and the planar weakened panel area of the container so as to aid in the manufacturing and packaging process. The size of the such a container may be designed such that when hermetically sealed, the inner wall of the weakened panel area may contact the outer periphery of the enclosed product stack when the container contracts, thereby limiting the amount of controlled deformation. The enclosed product stack may actually provide some measure of lateral structural support to the sidewall of the hermetically sealed container when the internal pressure of the container is less than the ambient atmospheric pressure.

Figure 11A:
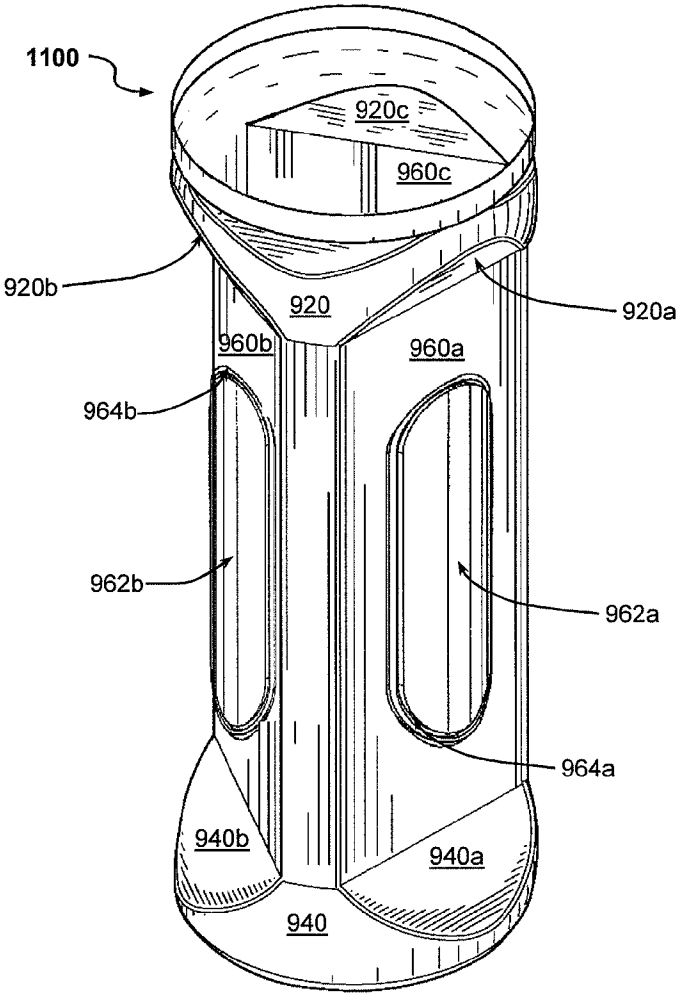
FIG. 11*a,b* are perspective views of yet another preferred embodiment of the container of the present invention illustrating the employment of a flowing geometries mechanism having a planar weakened panel area and further comprising a floating panel mechanism formed therein; and Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

Referring now to FIGS. 11*a-b*, additional preferred embodiments of the container 1100, 1100' of the present invention may be fashioned by incorporating the other previously discussed stress dissipating mechanisms into the preferred embodiment of the container 90 shown in FIG. 9*a*. For example, in FIG. 11*a*, the container 1100 incorporates a floating panel mechanism into the planar weakened panel area (e.g., 960*a*, 960*b*, 960*c*) of each flowing geometries mechanisms. The floating panel mechanisms are each comprised of a stable panel area (e.g., 962*a*, 962*b*) defined by an encompassing flexible corrugated suspension ring (e.g., 964*a*, 964*b*) formed within the confines of a weakened panel area (e.g., 960*a*, 960*b*) of a flowing geometries mechanism. The flexible corrugated suspension ring (e.g., 964*a*, 964*b*) surrounding the stable panel area (e.g., 962*a*, 962*b*) allows the entire stable panel area (e.g., 962*a*, 962*b*) to move flex uniformly (i.e., spring in and out) without randomly distorting or buckling the container. Thus, both the flowing geometries mechanisms and the floating panel mechanism incorporated therein, work in combination to counteract the compressive and expansive forces induced by changes in environmental conditions. Thus, the container 1100 smoothly alters its geometry in response to environmental conditions while maintaining its visual aesthetic appearance by avoiding random point buckling and deformation.

In another example, illustrated in FIG. 11*b*, the container 1100' further incorporates a morphing geometries mechanism and structural rigidity mechanisms in the form of three-dimensional figures 930. The three-dimensional figures 930 are typically positioned in a region of the container requiring added strength and stiffness. For example, in the container 1100' shown in FIG. 11*b*, the three-dimensional figures 930 are formed in the sidewall of the lower base section 940, which has a generally circular lateral cross-section. As noted in previous examples, the lower base section 940 (as well as the upper section 920) is generally designed to be more rigid so as to maintain its dimensional shape in order to properly focus the forces induced by changes in environmental conditions on the flowing geometries mechanisms.

Additionally, as shown in FIG. 11*b*, the distal end of the lower base section 940 the container 1100' is extended so as to allow a morphing geometries mechanism to be fashioned therein. The structure of the morphing geometries mechanism comprises an annular bellows means 954. As illustrated in previous examples shown in FIGS. 5*a-b*, the annular bellows means 954 expands (as shown in FIG. 5*a*) and contracts (as shown in FIG. 5*b*) along the container's longitudinal axis allowing a hermetically sealed container to repeatedly increase or decrease its internal volume to compensate for changing environmental conditions. Thus, the morphing geometries mechanism in conjunction with the flowing geometries mechanisms and the floating panel mechanism incorporated therein, work in combination to counteract the compressive and expansive forces induced by changes in environmental conditions. Thus, the container 1100' smoothly alters its geometry in response to environmental conditions while maintaining its visual aesthetic appearance by avoiding random point buckling and deformation.

It will now be evident to those skilled in the art that there has been described herein an improved container for storing fragile food products, and more particularly, to an improved blow molded container for storing potato chips and/or crisps, corn based chips and/or crisps, cookies and the like which is capable of adapting to changing environmental conditions while maintaining its visual aesthetic appearance. Although the invention hereof has been described by way of preferred embodiments, it will be evident that other adaptations and modifications can be employed without departing from the spirit and scope thereof. Thus, multiple stress dissipating mechanisms may be utilized in a single container. Additionally, while the containers of the present invention illustrated in the Figures have a generally circular traverse cross section, it is understood that the collection of stress dissipating mechanisms utilized in containers of the present invention may be employed on any containers having a generally annular traverse cross section. Thus, in addition to containers having a circular traverse cross-section, alternative embodiments of the container of the present invention may have a traverse cross section which is generally oval in shape. The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A thermo-plastic container for hermetically sealing a single stack of fragile articles, comprising:

a tubular body having a central longitudinal axis, said body comprised of a sidewall having a flowing geometries mechanism formed therein, which is positioned between a closed end and an open end having a hermetically sealable opening; wherein said hermetically sealable opening of said open end and portions of said sidewall at said closed end have circular lateral cross-sections of substantially equivalent diameters, and said sidewall includes a plurality of three-dimensional figures formed therein.

2. The container of claim 1 wherein the plurality of three-dimensional figures are evenly spaced.

3. The container of claim 1 wherein said sidewall further comprises a structural rigidity mechanism formed therein.

4. The container of claim 3 wherein said structural rigidity mechanism comprises an annular corrugated pattern formed therein.

5. The container of claim 1 wherein said plurality of three-dimensional figures increase structural rigidity.

* * * * *